US005702179A

United States Patent [19]

Sidwell et al.

[11] Patent Number: 5,702,179

[45] Date of Patent: Dec. 30, 1997

[54] DISCHARGE LAMP HAVING LIGHT-TRANSMISSIVE CONDUCTIVE COATING FOR RF CONTAINMENT AND HEATING

[75] Inventors: Steven C. Sidwell, Hopkinton, N.H.; George J. English, Reading, Mass.; Robert L. Garrison, Henniker; Ralph J. Johnson, Bedford, both of N.H.

[73] Assignee: Osram Sylvania, Inc., Danvers, Mass.

[21] Appl. No.: 537,513

[22] Filed: Oct. 2, 1995

[51] Int. Cl.[6] ..... F21V 9/00

[52] U.S. Cl. ..... 362/255; 362/221; 362/260; 362/265; 362/276; 362/293; 313/112; 313/113; 313/479; 315/85

[58] Field of Search ..... 313/110, 112, 313/113, 479, 493, 634, 635; 315/85; 362/255, 293, 294, 260, 263, 265, 217, 221, 276, 802

[56] References Cited

U.S. PATENT DOCUMENTS

| | | | |
|---|---|---|---|
| 1,792,599 | 2/1931 | Murray | 40/545 |
| 1,839,499 | 1/1932 | Rava | 362/80.1 |
| 1,854,654 | 4/1932 | Koch, Jr. | 40/545 |
| 3,067,356 | 12/1962 | Ray | 313/221 |
| 3,587,167 | 6/1971 | Levin | 313/113 |
| 3,609,293 | 9/1971 | Stewart et al. | 219/200 |
| 3,717,781 | 2/1973 | Sadoski et al. | 313/109 |
| 3,801,808 | 4/1974 | Johnson | 240/2.1 |
| 3,885,150 | 5/1975 | Ott | 362/293 |
| 3,963,954 | 6/1976 | Milke et al. | 313/489 |
| 3,967,153 | 6/1976 | Mike et al. | 313/489 |
| 4,020,385 | 4/1977 | Lagos | 313/489 |
| 4,500,810 | 2/1985 | Graff | 313/486 |
| 4,568,859 | 2/1986 | Houkes et al. | 315/248 |
| 4,655,810 | 4/1987 | Van Cauter et al. | 65/60.4 |
| 4,682,146 | 7/1987 | Friedman, III | 340/77 |
| 4,767,969 | 8/1988 | Green | 313/479 |
| 4,783,279 | 11/1988 | Petermann et al. | 252/511 |
| 4,825,128 | 4/1989 | Sprengers | 313/635 |
| 4,924,141 | 5/1990 | Taubner et al. | 313/488 |
| 4,956,573 | 9/1990 | Smith et al. | 313/15 |
| 4,970,376 | 11/1990 | Mellor et al. | 219/543 |
| 5,013,966 | 5/1991 | Saikatsu et al. | 313/493 |
| 5,287,258 | 2/1994 | Remus | 362/256 |
| 5,317,132 | 5/1994 | Clough et al. | 219/543 |
| 5,333,073 | 7/1994 | Suzuki | 359/50 |
| 5,354,966 | 10/1994 | Sperbeck | 219/203 |
| 5,397,966 | 3/1995 | Vrionis et al. | 315/248 |

OTHER PUBLICATIONS

Automotive Industries, Jul. 1995, p. 126.

*Primary Examiner*—Alan Cariaso
*Attorney, Agent, or Firm*—Wolf, Greenfield & Sacks, P.C.

[57] ABSTRACT

A discharge lamp, such as a neon lamp or a subminiature fluorescent lamp, includes an elongated tubular lamp envelope containing a fill material for supporting a light-emitting discharge and electrodes mounted at opposite ends of the lamp envelope. A light-transmissive conductive coating on the lamp envelope substantially attenuates emission of RF energy. A conductor in electrical contact with the conductive coating couples the conductive coating to a reference potential, such as ground. The conductor may be a metal or conductive silicone strip in electrical contact with the conductive coating along the length of the lamp envelope. The discharge lamp may be connected to a ballast circuit by coaxial cables. The outer conductor of each coaxial cable is connected to the conductive coating to form a continuous RF shield. The conductive coating and/or the metal strip may be used for heating of the discharge lamp.

34 Claims, 6 Drawing Sheets

DISCHARGE LAMP HAVING LIGHT-TRANSMISSIVE CONDUCTIVE COATING FOR RF CONTAINMENT AND HEATING

FIELD OF THE INVENTION

This invention relates to low pressure discharge lamps which are energized by high frequency electrical energy and, more particularly, to discharge lamps having a light-transmissive conductive coating. The invention is particularly useful in vehicles for neon lamp assemblies which may require RF containment, and for fluorescent lamp assemblies which may require heating and RF containment.

BACKGROUND OF THE INVENTION

It has become customary in automobiles and other vehicles to utilize a stop/brake light which is located high on the rear of the vehicle and is centered for improved visibility. The stop light may, for example, be located in the rear window. In sport-utility vehicles which have a tailgate, the stop light may be located above the rear window. Such stop lights are typically elongated and may be 20 or more inches long. In order to achieve uniform illumination over this length, neon lamps may be used. In general, neon lamps have relatively low power consumption and long operating lives.

It has been proposed in the prior art to use neon lamps for signaling in vehicles. A neon lamp direction signal, including arrows for indicating direction, is disclosed in U.S. Pat. No. 1,792,599 issued Feb. 17, 1931 to Murray. The disclosed lamp also includes a stop signal indication. A neon sign, including a neon lamp tube for mounting in the window of an automobile, is disclosed in U.S. Pat. No. 1,854,654 issued Apr. 19, 1932 to Koch, Jr. et al. A neon lamp signaling device for mounting in the rear window of a vehicle is disclosed in U.S. Pat. No. 1,839,499 issued Jan. 5, 1932 to Rava. A rare gas automobile indicator light system employing a single horizontally disposed indicator tube operated to provide braking, parking, emergency flasher and turn indications is disclosed in U.S. Pat. No. 4,682,146 issued Jul. 21, 1987 to Friedman, III.

Neon lamps may be energized at a frequency on the order of 60 kilohertz. The starting voltage may be on the order of 3 kilovolts, and the operating voltage may be on the order of 1 kilovolt. It is important to insure that the neon lamp assembly does not emit radiation which may potentially interfere with nearby electronic equipment in the vehicle, in other vehicles and in adjacent buildings. In one prior art neon lamp assembly, the light transmitting aperture is covered with a conductive mesh that substantially blocks emission of RF radiation generated within the lamp assembly.

Subminiature fluorescent lamps utilized in vehicles may be operated at a frequency in the range of 17 to 35 kHz. It is important to insure that such subminiature fluorescent lamps do not emit radiation which may produce interference as described above.

A pilot lamp fixture having a transparent conductive shield positioned in front of the pilot lamp for reducing or eliminating RF interference is disclosed in U.S. Pat. No. 3,801,808 issued Apr. 2, 1974 to Johnson. A headlamp for motor vehicles, including a gas discharge lamp, a glass or plastic screen and a transparent metallic coating on the discharge lamp or on the screen for shielding interference radiation, is disclosed in U.S. Pat. No. 5,287,258 issued Feb. 15, 1994 to Remus. Fluorescent lamps having a transparent, electrically-conductive coating on the inner surface of the lamp envelope for reducing ignition voltage are disclosed in U.S. Pat. No. 3963 954 issued Jun. 15, 1976 to Milke et a; U.S. Pat. No. 3,967,153 issued Jun. 29, 1976 to Milk et al; U.S. Pat. No. 4,020,385 issued Apr. 26, 1977 to Lagos and U.S. Pat. No. 4,500,810 issued Feb. 19, 1995 to Graff. A low pressure mercury vapor discharge lamp having an interference-suppressing transparent conductive layer on its inside surface is disclosed in U.S. Pat. No. 4,568,859 issued Feb. 4, 1986 to Houkes et al. The conductive layer is connected to an electric supply lead-in wire.

Subminiature fluorescent lamps may be utilized in an environment where they are subjected to low temperatures. For example, subminiature fluorescent lamps may be utilized for illumination of instrument panels in vehicles. Under these conditions, temperatures of −40° F. or lower may be encountered. At such low temperatures, the fluorescent lamp may have a long warm-up time before reaching full light output. Thus, it may be necessary to provide a lamp heater. In the prior art, a heater comprising a flexible printed circuit having a heating element formed thereon has been attached to the fluorescent lamp with an adhesive. However, the printed circuit heater occasionally lifts off the fluorescent lamp. In addition, the limited thermal transfer between the printed circuit heater and the lamp requires a relatively high power input to the heater.

A heater for a glass substrate including an electrically-conductive transparent film is disclosed in U.S. Pat. No. 4,970,376 issued Nov. 13, 1990 to Mellor et al. A window defogging system including an indium tin oxide heater is disclosed in U.S. Pat. No. 5,354,966 issued Oct. 11, 1994 to Sperbeck. A glazed window which includes a transparent conductive coating for heating is disclosed in U.S. Pat. No. 3,609,293 issued Sep. 28, 1971 to Stewart et al.

SUMMARY OF THE INVENTION

According to a first aspect of the present invention, a lamp assembly comprises a housing having an aperture for emission of light and a discharge lamp mounted within the housing for emission of light through the aperture. The discharge lamp includes an elongated tubular lamp envelope containing a fill material for supporting a light-emitting discharge and electrodes mounted at opposite ends of the lamp envelope. The lamp assembly further comprises a light-transmissive conductive coating on the lamp envelope for substantially attenuating emission of RF energy from the discharge lamp during operation and a conductor in electrical contact with the conductive coating for coupling the conductive coating to a reference potential, such as ground.

The light-transmissive conductive coating may comprise indium tin oxide. The conductor may be in contact with the conductive coating along a substantial portion of the length of the lamp envelope to provide a low impedance connection between the conductive coating and ground. In one embodiment, the conductor comprises a metal strip in electrical contact with the light-transmissive conductive coating along the length of the lamp envelope. In a second embodiment, the conductor comprises a conductive silicone strip in electrical contact with the light-transmissive conductive coating along the length of the lamp envelope. In a third embodiment, the conductor comprises a reflective coating on a portion of lamp envelope to control the light distribution pattern of the discharge lamp. The reflective coating may be patterned to define an aperture for emission of light from the discharge lamp. The conductor may further comprise a conductive silicone tube positioned around an end of the lamp envelope in electrical contact with the light-transmissive conductive coating. The conductive silicone tube provides a non-abrasive contact to the conductive coating.

Electrical energy may be coupled to the electrodes of the discharge lamp through a coaxial cable having a center conductor and an outer shield. In this embodiment, the center conductor is electrically connected to one of the electrodes of the discharge lamp, and the outer shield may be electrically connected to the light-transmissive conductive coating. A conductive silicone tube positioned around an end of the lamp envelope may be used to electrically interconnect the conductive coating to the outer shield of the coaxial cable. The lamp assembly may further include a transformer positioned adjacent to and electrically connected to one of the electrodes, and a power source for supplying electrical energy to the transformer.

According to another aspect of the invention, the discharge lamp comprises an elongated tubular lamp envelope containing a fill material for supporting a light-emitting discharge and electrodes mounted at opposite ends of the lamp envelope, a light-transmissive conductive coating on the lamp envelope for substantially attenuating emission of RF energy during operation and a low impedance conductive strip on the lamp envelope along a substantial portion of its length. The conductive strip is in electrical contact with the light-transmissive conductive coating for low impedance coupling of the conductive coating to a reference potential.

According to a further aspect of the invention, a lamp assembly comprises a discharge lamp including an elongated tubular lamp envelope containing a fill material for supporting a light-emitting discharge and electrodes mounted at opposite ends of the lamp envelope, a light-transmissive conductive coating on the lamp envelope for substantially attenuating emission of RF energy from the discharge lamp during operation, a conductor for coupling the conductive coating to a reference potential, a power source for supplying electrical energy to the discharge lamp, and means for coupling the electrical energy from the power source to the electrodes.

According to still another aspect of the invention, the light-transmissive conductive coating and/or the conductive strip on the lamp envelope may be used for heating of fluorescent discharge lamps, as well as for RF containment. An electrical circuit supplies current to the conductive strip and/or the conductive coating when the discharge lamp is below a predetermined temperature. The current produces heating of the discharge lamp. The electrical circuit may comprise a DC power source and a thermal switch connected between the DC power source and the conductive strip and/or the conductive coating. Other sensing techniques, such as monitoring lamp performance, may also be utilized.

BRIEF DESCRIPTION OF THE DRAWINGS

For a better understanding of the present invention, reference is made to the accompanying drawings, which are incorporated herein by reference, and in which.

DETAILED DESCRIPTION

Figure 1:
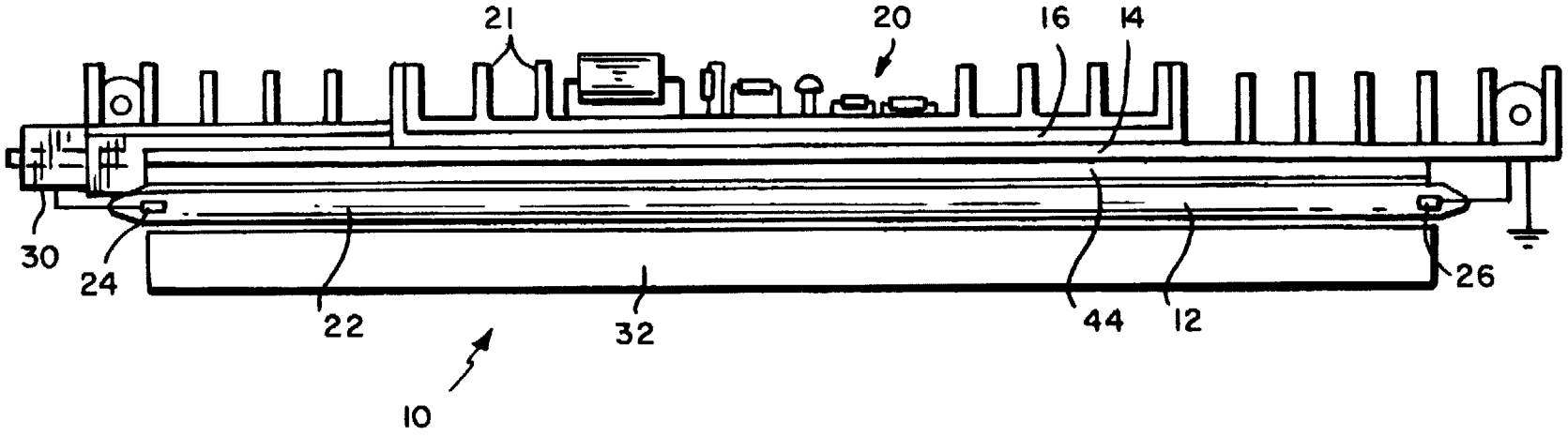
FIG. 1 is a top view of a lamp assembly in accordance with a first embodiment of the invention.
Figure 2:
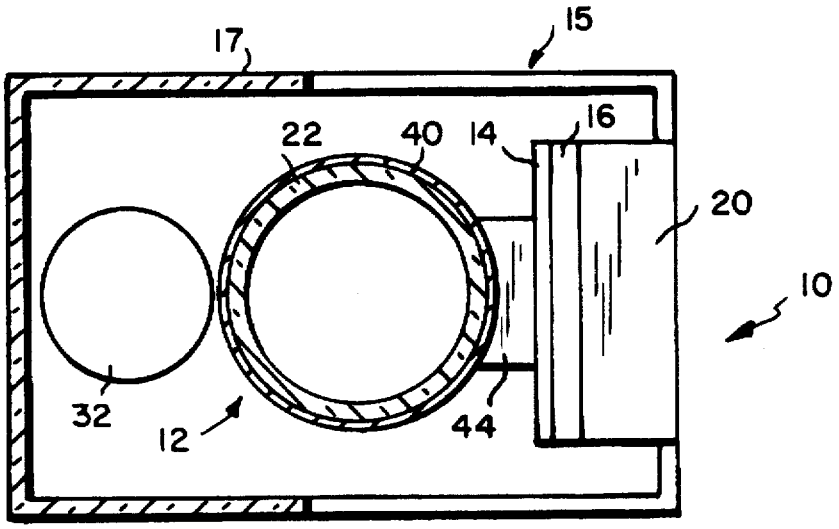
FIG. 2 is a cross section of the lamp assembly of FIG. 1.

A lamp assembly 10 in accordance with a first embodiment of the invention is shown in FIGS. 1 and 2. The lamp assembly 10 includes a discharge lamp 12 mounted in a lamp housing 15, shown schematically in FIG. 2, having a light-transmissive portion 17 for emission of light from discharge lamp 12. A ground plane 14 and an insulator 16 are mounted in housing 15 behind discharge lamp 12. A ballast circuit 20, which may be mounted on the rear of insulator 16, is connected to one electrode of discharge lamp 12 through a high voltage step-up transformer 30. The ballast circuit 20 supplies electrical energy of suitable voltage and frequency for starting and operating the discharge lamp 12. The ballast circuit 20 may be provided with thermally conductive fins 21 to assist in temperature control. An optical element 32, such as a rod or lens, may be positioned in front of the discharge lamp 12 to modify the emitted light pattern.

The lamp assembly 10 may have an elongated configuration designed for use as a stop light in a sport utility vehicle or other vehicle. The lamp assembly may have an overall length on the order of 20 inches or more. It will be understood that the lamp assembly 10 can have other dimensions and form factors within the scope of the present invention.

The discharge lamp 12 includes an elongated lamp envelope 22 having electrodes 24 and 26 sealed therein at opposite ends. The discharge lamp contains a fill material for supporting a light-emitting discharge. In a preferred embodiment, the discharge lamp 12 is a neon lamp. Preferred electrodes 24 and 26 for discharge lamp 12 are disclosed in co-pending application Ser. No. 08/219,150 filed Mar. 29, 1994, which is hereby incorporated by reference. Each electrode is connected through a press seal to an external contact pin. In a preferred embodiment, the lamp envelope 22 has an outside diameter of about 5 millimeters. Lamp fill materials may include neon or neon/argon at pressures from 10–150 torr, depending on the application and/or electronics.

A 20 inch neon lamp may be operated at a frequency of 60 kHz and a voltage of about 1000 volts, with a required starting voltage of about 3000 volts. It will be understood that neon lamps having different lengths and fill pressures will require different starting and operating voltages.

In the discharge lamp 12, a high electric field is induced in the region of each electrode by the applied voltage. Since an AC voltage is applied to the lamp, the lamp acts as a dipole radiation source. To induce discharge in relatively high pressure lamps, relatively high voltages are needed.

Also, relatively high voltages are required for inducing discharge in long lamps. As a result, high pressure, long lamps have a stronger induced dipole radiation. In the example described above, the neon lamp requires an operating voltage of about 1000 volts and a starting voltage of about 3000 volts. The dipole radiation is primarily at the fundamental frequency of lamp operation typically 60 kHz. Due to resonances plasma banding and material-induced delays, harmonics and frequency spreading occur. A 60 kHz neon lamp may emit radio frequency (RF) noise at 60 kHz±5 kHz; 120 kHz±20 kHz; 240 kHz±60 kHz; etc. In general, longer and more powerful lamps emit more RF noise.

In accordance with one aspect of the invention, the lamp envelope 22 is coated with a light-transmissive conductive coating 40, which functions as an RF shield. As discussed below, the conductive coating 40 is electrically connected to a reference potential, such as ground, and substantially attenuates RF noise generated within the discharge lamp 12. A preferred conductive coating 40 is indium tin oxide (ITO). The ITO coating may have a thickness selected to provide a conductivity of about 200–1000 ohms per square centimeter and is preferably applied to the lamp envelope 22 by dipping. This ITO coating attenuates the light output from the neon lamp by about 10%–20%. Other suitable light-transmissive conductive coatings may include very thin metals, fluorine-doped tin oxide and zinc oxide.

As noted above, the conductive coating 40 is electrically connected to a reference potential, such as ground. Over the length of a 20 inch discharge lamp, the impedance of the conductive coating 40 is not negligible and may be sufficient to result in a loss of RF shielding effectiveness. As known in the art, RF shielding is most effective for a shield with a low electrical impedance at frequencies where RF shielding is required. In accordance with a further aspect of the invention, a low impedance conductor is in electrical contact with the conductive coating 40 over all or a portion of the length of the lamp envelope 22. In the embodiment of FIGS. 1 and 2, a conductive silicone strip 44 with low electrical impedance is positioned between ground plane 14 and discharge lamp 12 and contacts the conductive coating 40 over a major portion of the length of the lamp envelope 22. Thus, the conductive silicone strip 44 provides a low impedance electrical connection between conductive coating 40 and ground plane 14 along the length of the lamp envelope. The silicone strip 44 is preferably resilient to insure contact with conductive coating 40 and to provide cushioning for the discharge lamp 12, and preferably has a resistance of less than one ohm per inch. A commercially available conductive silicone may be used.

It will be understood that the lamp assembly shown in FIGS. 1 and 2 and described above is given by way of example and is not limiting as to the scope of the present invention. A wide variety of different housing configurations can be utilized. Furthermore, the ballast circuit 20 and the transformer 30 may be mounted remotely from the discharge lamp 12. As described below, RF noise emission from the lamp assembly is reduced when the ballast and the transformer are mounted in close proximity to the discharge lamp.

Figure 3:
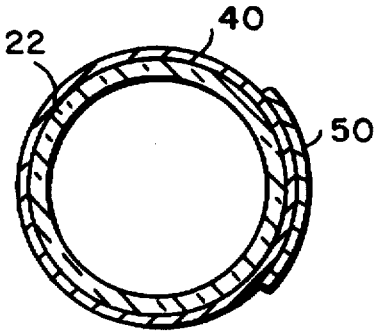
FIG. 3 is a cross section of a discharge lamp in accordance with a second embodiment of the invention.

A second embodiment of a discharge lamp in accordance with the present invention is shown in FIG. 3. Like elements in FIGS. 2 and 3 have the same reference numerals. In the embodiment of FIG. 3, a metal strip 50 is in contact with conductive coating 40 over all or a substantial portion of the length of the lamp envelope 22. The metal strip 50 provides a low impedance electrical contact to the conductive coating 40. The metal strip 50 is connected, as described below, to a reference potential, such as ground. The metal strip 50 may be deposited directly over or under the conductive coating 40 and is positioned on the lamp envelope 22 to minimize blockage of useful light output. Thus, the metal strip 50 may have a minimum width that provides the desired impedance and may be positioned facing the opaque portion of the housing. In a preferred embodiment, the metal strip is aluminum and may be applied to the lamp envelope 22 by evaporation or painting.

Figure 4:
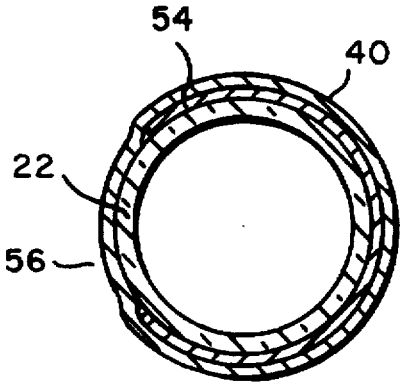
FIG. 4 is a cross section of a discharge lamp in accordance with a third embodiment of the invention.

A third embodiment of a discharge lamp in accordance with the present invention is shown in FIG. 4. Like elements in FIGS. 2 and 4 have the same reference numerals. In the embodiment of FIG. 4, a metal strip 54 provides a low impedance electrical contact to conductive coating 40 which is connected to a reference potential, such as ground. The metal strip 54 additionally functions as a reflective coating on lamp envelope 22 and defines an aperture 56 for emission of light from the discharge lamp. The metal strip 54 covers all of the lamp envelope 22 except aperture 56 and has a reflective inside surface, so that light generated within the discharge lamp is reflected through aperture 56. The metal strip 54 performs best optically when it is under the conductive coating. The coating provides the additional benefit of acting as a protective coating for the metal strip.

Figure 5:
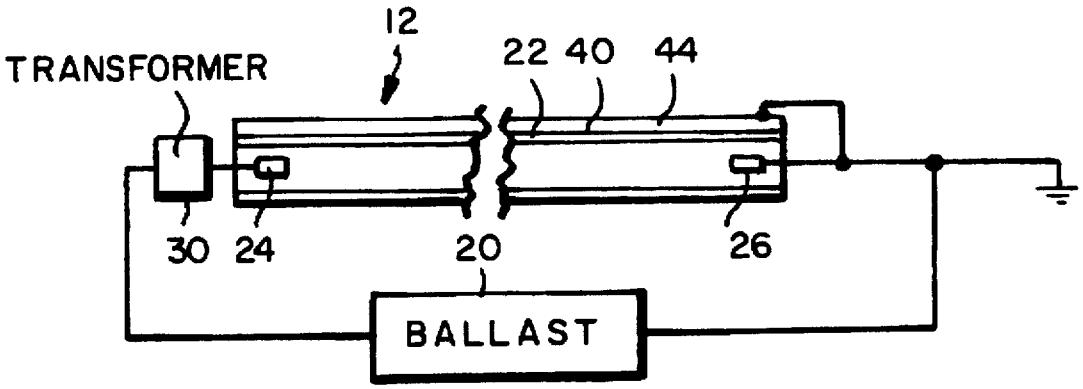
FIG. 5 is an electrical schematic diagram of the lamp assembly of FIG. 1.

The electrical connections of the lamp assembly of FIGS. 1 and 2 are shown in the schematic diagram of FIG. 5. One output terminal of the ballast circuit 20 is connected through transformer 30 to electrode 24. The other output terminal of the ballast circuit 20 is connected to electrode 26 and to ground. The conductive silicone strip 44, which electrically contacts the conductive coating 40 over the length of lamp envelope 22, is electrically connected to ground. In an alternate configuration, a step-up transformer may be required at each end of the discharge lamp 12. In this configuration, electrode 26 is not grounded, and a balanced voltage is applied to the discharge lamp 12.

Figure 6:
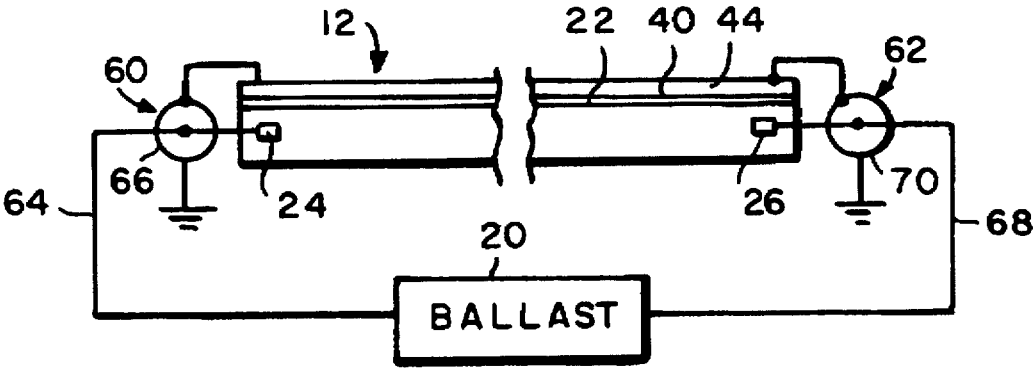
FIG. 6 is an electrical schematic diagram of a lamp assembly in accordance with another embodiment of the invention.

Another embodiment of the invention, wherein the ballast circuit 20 is located remotely from the discharge lamp 12, is shown schematically in FIG. 6. The terminal of the bassast circuit 20 are connected to electrodes 24 and 26 of discharge lamp 12 by coaxial cables 60 and 62, respectively. Coaxial cable 60 includes a center conductor 64 connected between one output terminal of ballast circuit 20 and electrode 24, and an outer conductor 66 that is grounded. Coaxial cable 62 includes a center conductor 68 that is connected between the other output terminal of ballast circuit 20 and electrode 26, and an outer conductor 70 that is grounded. The light-transmissive conductive coating 40 and silicone strip 44 are electrically connected to outer conductors 66 and 70 of coaxial cable 60 and 62, respectively, to provide substantially continuous RF shielding of the lamp assembly from the ballast circuit 20 to and including discharge lamp 12. As noted above, the discharge lamp 12 may be energized with a balanced voltage as shown in FIG. 6 or may utilize a single-ended drive wherein one of the electrodes is grounded, as shown in FIG. 5.

In the embodiment of FIG. 6, step-up transformers are located in ballast circuit 20, and the required starting and operating voltages are transmitted through coaxial cables 60 and 62 to discharge lamp 12. In an alternative configuration, a step-up transformer may be mounted in close proximity to one or both electrodes of discharge lamp 12. A coaxial cable is connected between each step-up transformer and the remotely located ballast circuit.

In summary, several configurations may be utilized. The ballast circuit 20 may be located in close proximity to the discharge lamp 12 or may be located remotely. An advantage of mounting the ballast circuit close to the discharge lamp is that lead lengths are minimized and RF shielding is easier. An advantage of remote location of the ballast circuit is that the ballast circuit can be used to energize two or more discharge lamps in different locations. In addition, practical considerations, such as available space, may dictate remote location of the ballast circuit. When the ballast circuit is remotely located, the connections to the discharge lamp are preferably made by coaxial cable, with the outer conductor of the coaxial cable connected to the conductive coating on the discharge lamp to provide continuous RF shielding to the extent possible. Furthermore, step-up transformers may be connected to one or both electrodes of the discharge lamp, depending on whether a grounded or a balanced drive configuration is utilized. The step-up transformer or transformers may be located in the ballast circuit or, more preferably, are located in close proximity to the electrodes of the discharge lamp to which they are connected. In each case, the RF shielding is provided on the discharge lamp and the electrical connections to the ballast circuit. Preferably, the ballast circuit is also shielded to reduce RF emissions.

In the configurations shown in FIGS. 5 and 6 and described above, the silicone strip 44 can be replaced with metal strip 50 shown in FIG. 3 or metal strip 54 shown in FIG. 4. In addition, when the conductive coating 40 has sufficiently high conductivity to provide effective RF shielding, the conductive coating alone can be utilized, with the conductive coating connected to a reference potential, such as ground, at one or both ends of the discharge lamp.

Figure 7:
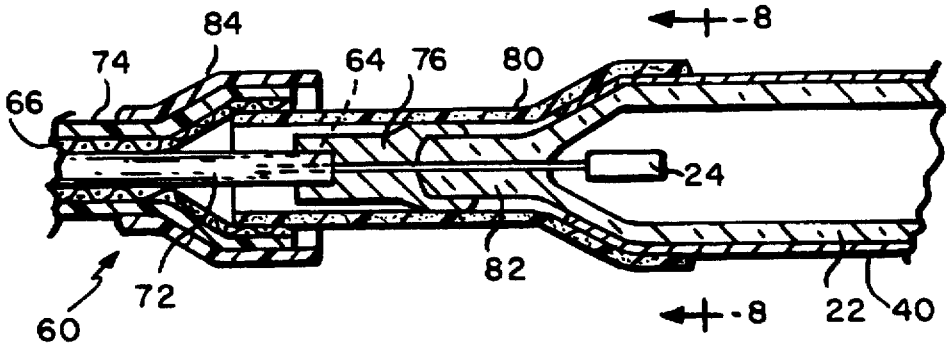
FIG. 7 is a pictorial representation of one end of a discharge lamp in accordance with the invention, illustrating the electrical connections to the discharge lamp.

A preferred configuration for connecting the discharge lamp 12 to the coaxial cable 60 is shown pictorially in FIG. 7. The coaxial cable 60 includes center conductor 64, outer conductor 66, typically in the form of a braided wire, and an insulator 72 between center conductor 64 and outer conductor 66. The coaxial cable also includes an outer jacket 74 surrounding outer conductor 66. The center conductor 64 is electrically connected to electrode 24 by attaching it to the lead wire which extends from electrode 24 through lamp envelope 22. The connection between center conductor 74 and the lead wire is surrounded with an insulator 76 such as silicone.

The conductive coating 40 on the outer surface of lamp envelope 22 is preferably connected to outer conductor 66 by a conductive silicone tube 80. As shown in FIG. 7 the conductive coating 40 preferably covers the main portion of lamp envelope 22 except for a seal region 82 near the electrode leads and preferably extends at least slightly beyond the electrode 24 toward seal region 82. The conductive silicone tube 80 provides a nonabrasive and reliable electrical connection to conductive coating 40. When the discharge lamp 12 includes a metal strip as shown in FIGS. 3 and 4 or a silicone strip as shown in FIG. 2, the silicone tube 80 is in electrical contact with both the conductive coating 40 and the metal or silicone strip. Preferably, the silicone tube 80, in its unstretched state, is smaller in diameter than lamp envelope 22. The silicone tube 80 is stretched to a larger diameter to place it over lamp envelope 22, and the resilience of silicone tube 80 provides secure electrical contact with the conductive coating 40 and any metal or silicone strip that may be present on lamp envelope 22. The silicone tube 80 may be positioned inside the outer conductor 66 of coaxial cable 60, as shown in FIG. 7, or may be positioned outside outer conductor 66. The outer conductor 66 and the silicone tube may be secured in electrical contact by a heat shrinkable tube 84. Optionally, a heat shrinkable tube may also be used to secure the silicone tube 80 in electrical contact with conductive coating 40. The configuration shown in FIG. 7 and described above provides a continuous RF shield around the lamp envelope 22, through the silicone tube 80 and the outer conductor 66 of coaxial cable 60 to the ballast circuit, thus providing substantial attenuation of RF noise.

Figure 8:
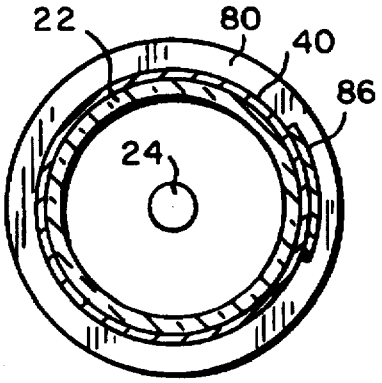
FIG. 8 is a cross-sectional view of the lamp assembly shown in FIG. 7.

A cross section of the assembly of FIG. 7 through the electrode 24 is shown in FIG. 8. The conductive coating 40 is surrounded by conductive silicone tube 80, thus providing a large area, nonabrasive electrical contact. In the embodiment of FIG. 8, a metal strip 86, is provided along the length of lamp envelope 22. As shown, the silicone tube 80 makes electrical contact with metal strip 86 thus providing a low impedance contact to the conductive coating 40 along the length of the lamp envelope 22.

The conductive tube 80 provides a reliable, nonabrasive, large area electrical contact to the conductive coating 40. In addition, the silicone tube 80 is resilient and can be used for shock resistant mounting of the discharge lamp 12. The silicone tube 80 as well as the silicone strip 44 conduct heat from the discharge lamp. The ITO conductive coating on the lamp envelope provides a shield to reduce RF noise emission and is oxidation and abrasion resistant.

Figure 9:
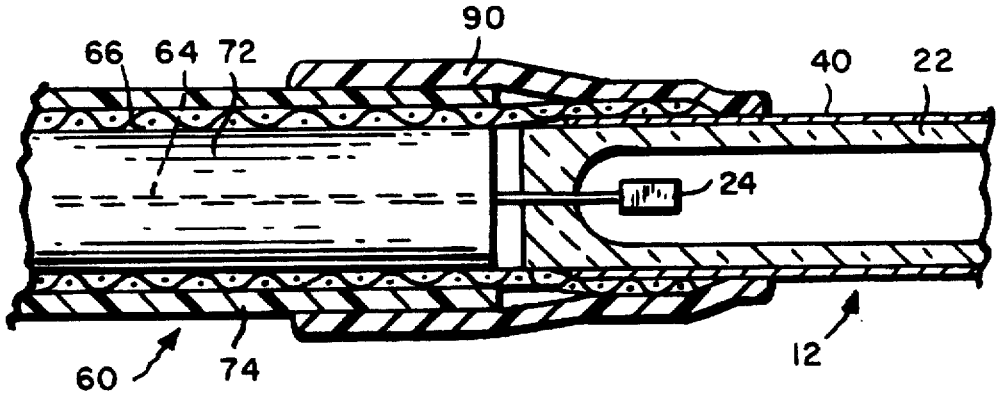
FIG. 9 is a partial cross-sectional view of another embodiment of a lamp assembly in accordance with the invention.

An alternative configuration for connecting the coaxial cable to the discharge lamp is shown in FIG. 9. Like elements in FIGS. 8 and 9 have the same reference numerals. The center conductor 64 of coaxial cable 60 is connected to electrode 24 as described above. In this configuration, the outer conductor 66 of coaxial cable 60 is in direct contact with conductive coating 40. The connection between coaxial cable 60 and discharge lamp 12 is secured by a heat shrinkable tube 90 which maintains electrical contact between outer conductor 66 and conductive coating 40.

Figure 10:
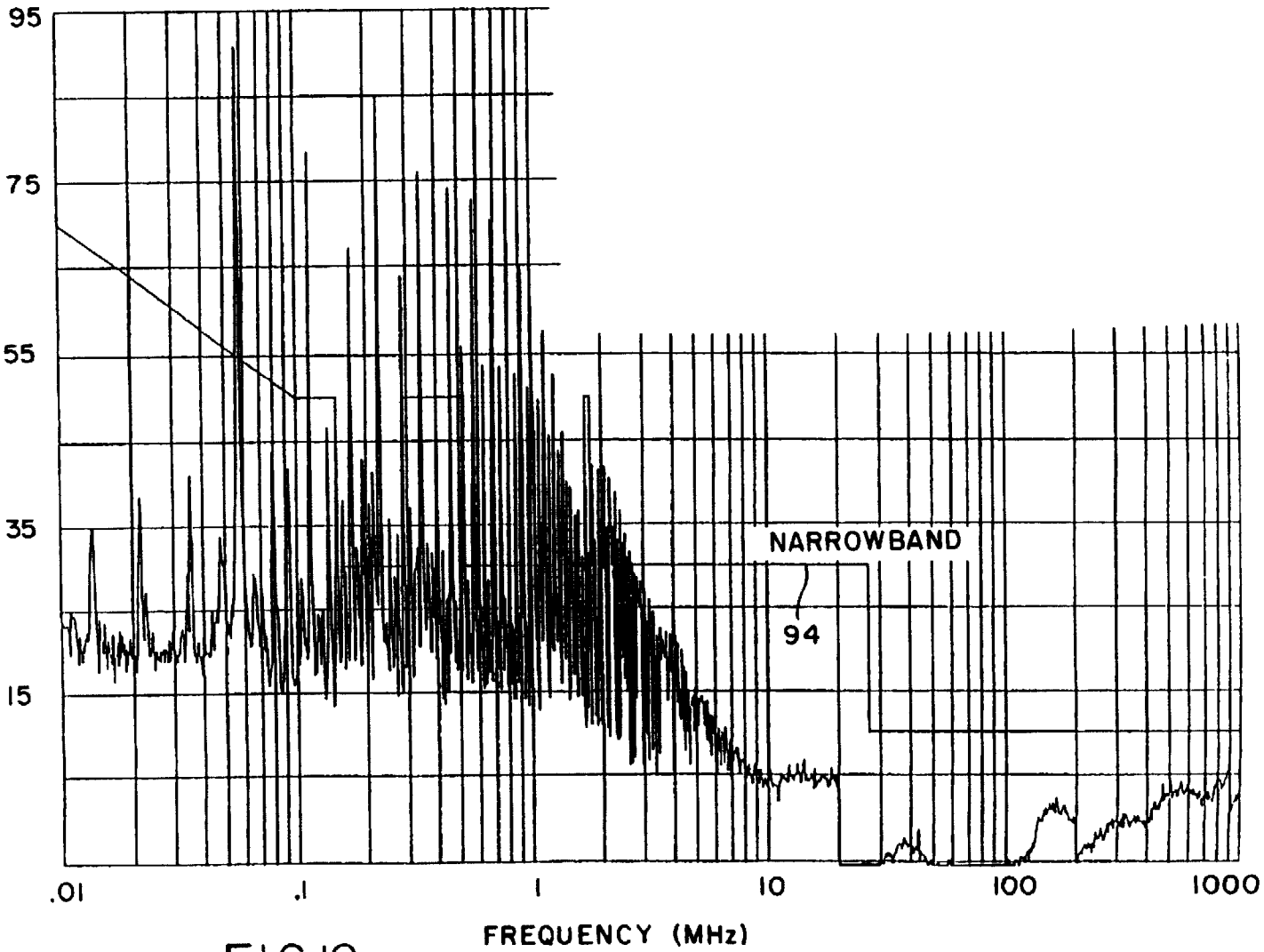
FIG. 10 is a graph of RF emission level as a function of frequency for a prior art discharge lamp.
Figure 11:
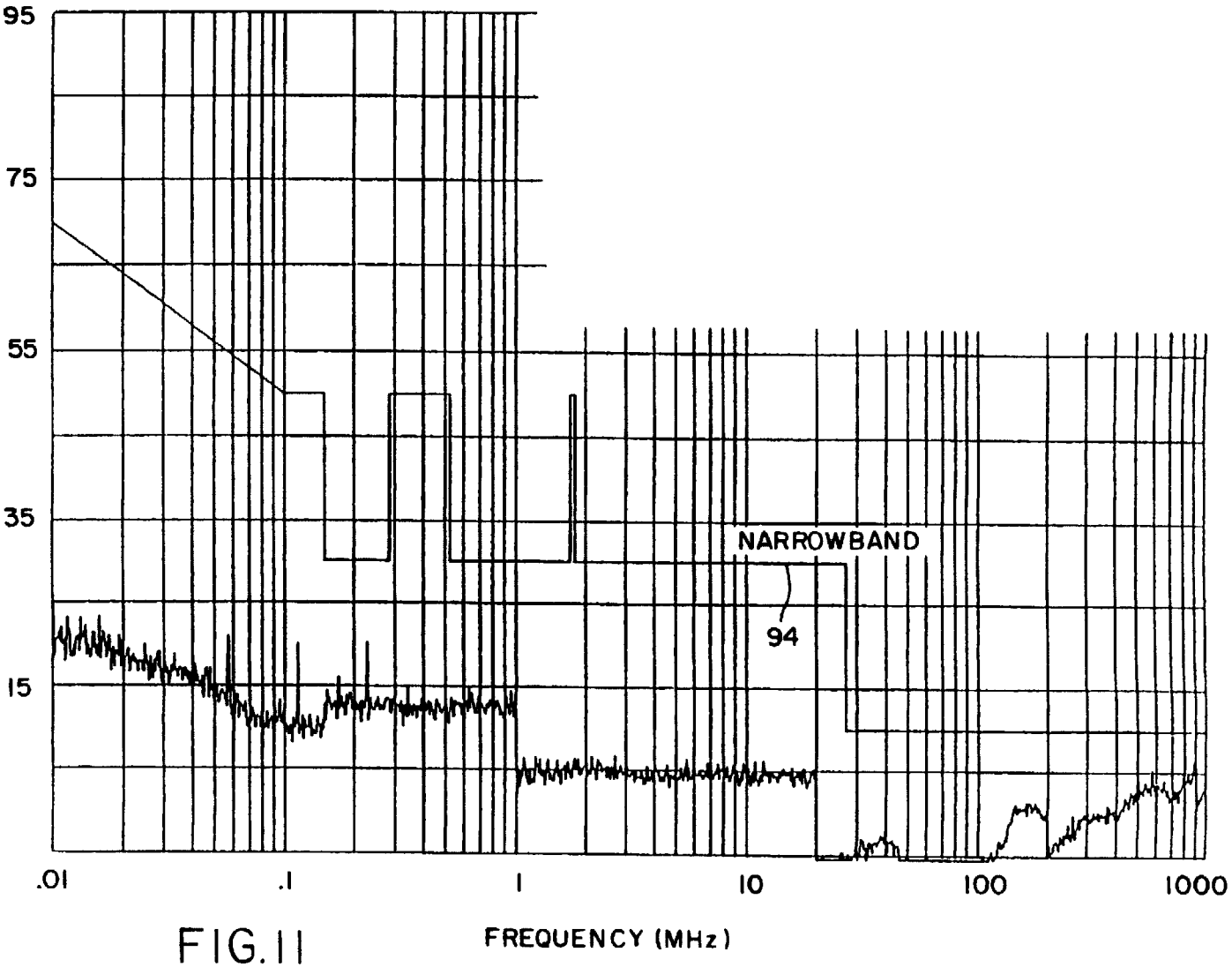
FIG. 11 is a graph of RF emission level as a function of frequency for a discharge lamp in accordance with the invention.

The effectiveness of the present invention in reducing RF noise emission from a neon lamp assembly is illustrated in FIGS. 10 and 11. Each of FIGS. 10 and 11 is a graph of RF emission level as a function of frequency. FIG. 10 illustrates the RF emission from an 18 inch neon lamp without a conductive coating operated at 3000 volts and 60 kHz (30 watts system power). FIG. 11 illustrates the RF emission from a neon lamp operated in the same manner having an indium tin oxide coating and a metal coating which defines an aperture, as shown in FIG. 4. The RF emission levels were measured in a certified testing laboratory. In FIGS. 10 and 11, a line 94 represents a specification for a maximum acceptable level of RF emission over the frequency range. As shown in FIG. 10, the neon lamp without a conductive coating exceeds the specification significantly. The neon lamp having a conductive coating meets the specification over the entire frequency range, as shown in FIG. 11.

Figure 12:
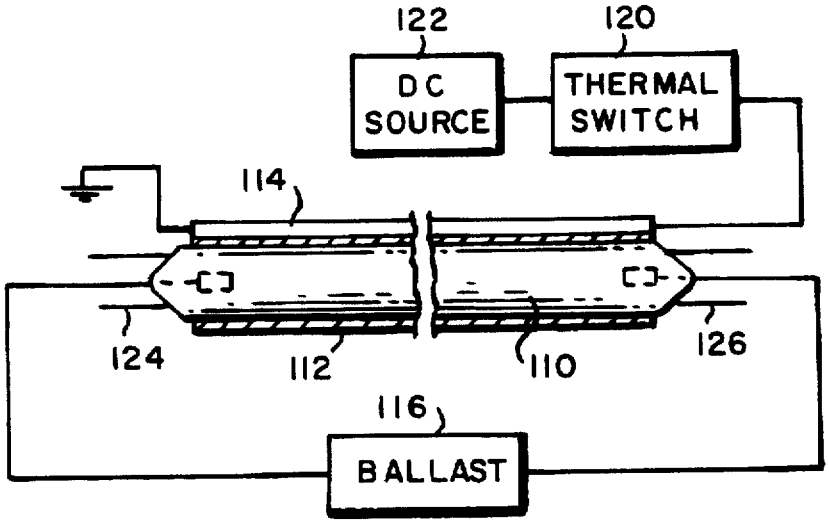
FIG. 12 is a schematic representation of another aspect of the invention wherein a conductive coating and a conductive strip are is used for heating and RF containment in a fluorescent lamp.

In accordance with a further aspect of the present invention, the light-transmissive conductive coating and/or the metal or silicone strip that contacts the conductive coating may be used as a heater for fluorescent lamps that may be subjected to low temperatures. As shown in FIG. 12, A subminiature fluorescent lamp 110 is provided with a light-transmissive conductive coating 112, such as ITO, and a conductive strip 114, such as a metal strip or a conductive silicone strip. The electrode leads of the fluorescent lamp 110 are connected to a ballast circuit 116 which supplies electrical energy for lamp operation. The conductive strip 114 is connected at one end to ground and is connected at the other end through a thermal switch 120 to a DC source 122. Insulators 124 and 126, shown schematically in FIG. 12, isolate the voltage applied to fluorescent lamp 112 by ballast circuit 116 from the DC voltage applied to conductive strip 114.

The thermal switch 120 may be positioned to sense the temperature of fluorescent lamp 112. When the temperature of the fluorescent lamp 112 is below a predetermined temperature, thermal switch 120 closes and connects DC source 122 to the conductive strip 114. When the thermal switch 120 is closed, an electrical current passes through conductive strip 114 and conductive coating 112, thereby heating fluorescent lamp 110. When the fluorescent lamp 110 is heated above the predetermined temperature or the ambient temperature is above the predetermined temperature, the thermal switch 120 opens, thereby discontinuing heating of fluorescent lamp 112.

The heating of fluorescent lamp 112 is produced by the electrical resistance of conductive strip 114 and conductive coating 112. The resistance is selected based on the voltage of DC source. 122, the length and diameter of fluorescent lamp 112, the expected minimum temperature and the desired power level. By way of example, a 4 inch fluorescent lamp can be heated at a power level of 3.5 watts, a voltage of 12.8 volts and a resistance of conductive strip 114 of about 40–50 ohms. The resistance value required for heating is sufficiently low to provide effective RF shielding.

The conductive strip 114 and the conductive coating 112 are connected to ground whether the thermal switch 120 is open or closed. Thus, the conductive coating 112 and the conductive strip 114 provide effective RF shielding of the fluorescent lamp 112, as well as heating of fluorescent lamp 112.

The conductive coating 112 and the conductive strip 114 provide more efficient transfer of heat to fluorescent lamp 112 than the prior art printed circuit heater. The conductive coating 112 assists in the transfer of heat around the diameter of the lamp. Thus, there are no cold spots for mercury to recondense within the fluorescent lamp. For a 4 inch fluorescent lamp at −40° C., 50% of full light output was achieved in less than 20 seconds using a conductive strip powered at about 3.5 watts. This was less than one third of the power required for heating of the same lamp with the prior art printed circuit heater.

It will be understood that different circuit configurations can be used for heating fluorescent lamp 112 by passing an electrical current through the conductive strip 114 and the conductive coating 112. For example, various types of thermal switches and other control circuits may be utilized. Sensing of lamp performance may be utilized as an alternative to sensing of lamp temperature.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A lamp assembly comprising:

a housing having an aperture for emission of light;

a discharge lamp mounted in said housing for emission of light through said aperture, said discharge lamp including an elongated tubular lamp envelope containing a fill material for supporting a light-emitting discharge and electrodes mounted at opposite ends of said lamp envelope;

a substantially continuous, light-transmissive conductive coating on said lamp envelope for substantially attenuating emission of radio frequency energy from said discharge lamp;

a conductor in electrical contact with said conductive coating for coupling said conductive coating to a reference potential; and means for coupling electrical energy to said electrodes.

2. A lamp assembly as defined in claim 1 wherein said light-transmissive conductive coating comprises indium tin oxide.

3. A lamp assembly as defined in claim 1 wherein said conductor is in electrical contact with said conductive coating along a substantial portion of the length of said lamp envelope.

4. A lamp assembly as defined in claim 1 wherein said conductor comprises a metal strip in electrical contact with said light-transmissive conductive coating along the length of said lamp envelope.

5. A lamp assembly as defined in claim 1 wherein said conductor comprises a conductive silicone strip in electrical contact with said light-transmissive conductive coating along the length of said lamp envelope.

6. A lamp assembly as defined in claim 1 wherein said conductor comprises a conductive silicone tube positioned around an end of said lamp envelope in electrical contact with said light-transmissive conductive coating.

7. A lamp assembly as defined in claim 1 wherein said conductor couples said light-transmissive conductive coating to ground.

8. A lamp assembly as defined in claim 1 wherein said conductor comprises a reflective coating on a portion of said lamp envelope.

9. A lamp assembly as defined in claim 8 wherein said reflective coating is patterned to define an aperture for emission of light from said discharge lamp.

10. A lamp assembly as defined in claim 1 wherein said discharge lamp comprises a neon lamp.

11. A lamp assembly as defined in claim 1 wherein said discharge lamp comprises a subminiature fluorescent lamp.

12. A lamp assembly as defined in claim 1 wherein said means for coupling electrical energy to said electrodes comprises a coaxial cable having a center conductor and an outer shield, said center conductor being electrically connected to one of said electrodes and said outer shield being electrically connected to said light-transmissive conductive coating by said conductor.

13. A lamp assembly as defined in claim 12 wherein said conductor includes a conductive silicone tube positioned around an end of said lamp envelope and providing an electrical connection between said conductive coating and said outer shield.

14. A lamp assembly as defined in claim 1 further including a transformer positioned adjacent to and electrically connected to one of the electrodes, and a power source for supplying electrical energy to said transformer.

15. A lamp assembly as defined in claim 1 further comprising an electrical circuit coupled to said conductor for supplying sufficient current through said conductor to heat said discharge lamp when said discharge lamp is below a predetermined temperature.

16. A lamp assembly as defined in claim 15 wherein said discharge lamp comprises a fluorescent lamp.

17. A discharge lamp comprising:

an elongated tubular lamp envelope containing a fill material for supporting a light-emitting discharge and electrodes mounted at opposite ends of said lamp envelope;

a substantially continuous, light-transmissive conductive coating on said lamp envelope for substantially attenuating emission of radio frequency energy during operation; and a low impedance conductive strip on said lamp envelope along a substantial portion of its length, said conductive strip being in electrical contact with said light-transmissive conductive coating for coupling said conductive coating to a reference potential.

18. A discharge lamp as defined in claim 17 wherein said light-transmissive conductive coating comprises indium tin oxide.

19. A discharge lamp as defined in claim 17 wherein said conductive strip comprises a metal strip in electrical contact with said light-transmissive conductive coating along the length of said lamp envelope.

20. A discharge lamp as defined in claim 17 wherein said conductive strip comprises a conductive silicone strip in electrical contact with said light-transmissive conductive coating along the length of said lamp envelope.

21. A discharge lamp as defined in claim 17 wherein said conductive strip comprises a reflective coating on a portion of said lamp envelope.

22. A discharge lamp as defined in claim 21 wherein said reflective coating is patterned to define an aperture for emission of light from said discharge lamp.

23. A discharge lamp as defined in claim 17 wherein said discharge lamp comprises a neon lamp.

24. A lamp assembly comprising:

a discharge lamp including an elongated tubular lamp envelope containing a fill material for supporting a light-emitting discharge and electrodes mounted at opposite ends of said lamp envelope;

a substantially continuous, light-transmissive conductive coating on said lamp envelope for substantially attenuating emission of radio frequency energy from said discharge lamp during operation;

a conductor for coupling said conductive coating to a reference potential;

a power source for supplying electrical energy to said discharge lamp; and means for coupling said electrical energy from said power source to said electrodes.

25. A lamp assembly as defined in claim 24 wherein said means for coupling electrical energy from said power source to said electrodes comprises a coaxial cable having a center conductor and an outer shield, said center conductor being electrically connected to one of said electrodes and said outer shield being electrically connected to said light-transmissive conductive coating by said conductor.

26. A lamp assembly as defined in claim 25 wherein said conductor includes a conductive silicone tube positioned around an end of said lamp envelope and providing an electrical connection between said conductive coating and said outer shield.

27. A lamp assembly as defined in claim 24 further comprising an electrical circuit coupled to said conductor for supplying sufficient current through said conductor to heat said discharge lamp when said discharge lamp is below a predetermined temperature.

28. A lamp assembly as defined in claim 27 wherein said discharge lamp comprises a fluorescent lamp.

29. A lamp assembly comprising:

a discharge lamp including an elongated, tubular lamp envelope containing a fill material for supporting a light-emitting discharge and electrodes mounted at opposite ends of said lamp envelope;

a conductive strip on said lamp envelope along a substantial portion of its length;

an electrical circuit coupled to said conductive strip for supplying sufficient current through said conductive strip to heat said discharge lamp when said discharge lamp is below a predetermined temperature; and a substantially continuous, light-transmissive conductive coating on said lamp envelope for substantially attenuating emission of radio frequency energy from said discharge lamp, said conductive coating being coupled by said conductive strip to a reference potential.

30. A lamp assembly as defined in claim 29 wherein said light-transmissive conductive coating comprises indium tin oxide.

31. A lamp assembly as defined in claim 29 wherein said electrical circuit comprises a power source and a thermal switch connected between said power source and said conductive strip, said thermal switch being in thermal contact with said discharge lamp and coupling electrical energy from said power source to said conductive strip when said discharge lamp is below said predetermined temperature.

32. A lamp assembly comprising:

a discharge lamp including an elongated tubular lamp envelope containing a fill material for supporting a light-emitting discharge and electrodes mounted at opposite ends of said lamp envelope.

a substantially continuous, light-transmissive conductive coating on said lamp envelope for substantially attenuating emission of radio frequency energy from said discharge lamp during operation;

a conductive strip on said lamp envelope along a substantial portion of its length, said conductive strip being in electrical contact with said light-transmissive conductive coating for coupling said conductive coating to a reference potential;

a power source for supplying electrical energy to said discharge lamp;

means for coupling said electrical energy from said power source to said electrodes; and an electrical circuit coupled to said conductive strip for supplying sufficient current through said conductive strip to heat said discharge lamp when said discharge lamp is below a predetermined temperature.

33. A lamp assembly as defined in claim 32 wherein said electrical circuit comprises a DC source and a thermal switch in thermal contact with said discharge lamp, said thermal switch coupling electrical energy from said DC source to said conductive strip when said discharge lamp is below said predetermined temperature.

34. A lamp assembly as defined in claim 32 wherein said discharge lamp comprises a fluorescent lamp.

* * * * *